US007382221B2

(12) United States Patent
Morimoto et al.

(10) Patent No.: US 7,382,221 B2
(45) Date of Patent: Jun. 3, 2008

(54) COIL

(75) Inventors: Yasunori Morimoto, Tokyo (JP); Hiromitu Kuriki, Tokyo (JP)

(73) Assignee: Sumida Corporation, Tokyo (JP)

( * ) Notice: Subject to any disclaimer, the term of this patent is extended or adjusted under 35 U.S.C. 154(b) by 1 day.

(21) Appl. No.: 10/589,616

(22) PCT Filed: Dec. 24, 2004

(86) PCT No.: PCT/JP2004/019399

§ 371 (c)(1),
(2), (4) Date: Aug. 16, 2006

(87) PCT Pub. No.: WO2005/078749

PCT Pub. Date: Aug. 25, 2005

(65) Prior Publication Data

US 2007/0171020 A1 Jul. 26, 2007

(30) Foreign Application Priority Data

Feb. 18, 2004 (JP) ..... 2004-041394

(51) Int. Cl.
*H01F 27/30* (2006.01)
*H01F 27/28* (2006.01)

(52) U.S. Cl. ..... 336/198; 336/208; 336/181; 336/180

(58) Field of Classification Search ..... 336/220, 336/222, 198, 180, 83, 192, 70, 181
See application file for complete search history.

(56) References Cited

U.S. PATENT DOCUMENTS 4,583,696 A * 4/1986 Mosher ..... 310/208
4,668,544 A * 5/1987 Takahashi ..... 428/593
6,069,549 A * 5/2000 Heritier-Best ..... 336/190
6,525,638 B2 * 2/2003 Oi ..... 336/215

FOREIGN PATENT DOCUMENTS

JP 59-126610 7/1984

(Continued)

*Primary Examiner*—Anh T Mai
(74) *Attorney, Agent, or Firm*—Oliff & Berridge, PLC

(57) ABSTRACT

The differences in characteristics among parts or the fluctuations of the inductance value of a coil due to temperature variation is lessened by reducing the stray capacitance components induced among the layers of wound conductor, and size reduction and cost reduction are achieved. A winding portion (30) between two flange portions (22*a*, 22*b*) is divided into a plurality of sections (30*a*, 30*b*, 30*c*, 30*d*). One layer of conductor is wound from one end to the other end in each section, and then layers of conductor are wound in the alternately reversed directions to form the multilayer winding portion (30) by solenoid winding. The conductor is preferably wound in such a way that the boundary surface between adjacent sections inclines to a flange portion, which is the winding start, and the boundary surface of an upper layer is closer to the flange portion than that of a lower layer. Further the conductor is preferably wound in such a way that at least portions near upper layers of end faces facing the flange portions are apart from the flange portions so as to be farther from the flange portions than lower layers of the end faces in each section at both ends. This divided solenoid winding coil can be used for an antenna coil or a transformer coil.

9 Claims, 4 Drawing Sheets

FOREIGN PATENT DOCUMENTS

| | | |
|---|---|---|
| JP | 02-156513 | 6/1990 |
| JP | 03-192708 | 8/1991 |
| JP | 06-333757 | 12/1994 |
| JP | 08-222464 | 8/1996 |
| JP | 09-129460 | 5/1997 |
| JP | 2003-332822 | 11/2003 |
| JP | 2004-048136 | 2/2004 |

* cited by examiner

COIL

TECHNICAL FIELD

The present invention relates to a coil, and an antenna and a transformer using the coil.

BACKGROUND ART

As shown in FIG. 9, for example, conventionally in a typical coil 510 used for an antenna and a transformer, a conductor 531 is wound from one end (flange portion 522*a*) to the other end (flange portion 522*b*) of a winding shaft portion 521 along the surface of the winding shaft portion 521 to form a first layer, and then the conductor 531 is in a reversed direction wound from the other end (flange portion 522*b*) to the one end (flange portion 522*a*) to form a second layer. Thereafter, the conductor 531 is similarly wound in alternately reversed directions to form a third layer and a fourth layer, so that a winding portion (coil portion) 530 is formed. Such a winding operation is called solenoid winding.

When the coil manufactured by solenoid winding is used as an antenna coil, a capacitor is connected in parallel with the coil, and the leading end and the terminal end of the conductor forming the coil are connected to the main part of a receiver, so that data can be received at a predetermined resonance frequency.

Generally in such a coil, stray capacitance components (parasitic capacitance components) occur between turns of conductor (coil) or terminal electrodes, and the stray capacitance components and the inductance components of the coil cause a resonance phenomenon. The resonance frequency of such a resonance phenomenon is called "self resonant frequency" and is the maximum frequency used for a coil (inductor) on a circuit. In general a frequency used for a coil is equal to or lower than one half to one fifth of the self resonant frequency.

As described above, in the antenna coil manufactured by solenoid winding, the conductor is wound from one end to the other end of the core, and then the conductor is in a reversed direction wound from the other end to the one end. For example, in FIG. 9, conductors adjacent to each other in the vertical direction on the one end are quite different in the number of turns. In other words, a length L2 of the layers is large and causes large stray capacitance components. The same phenomenon occurs on the second layer and the third layer on the other end.

Such large stray capacitance components considerably reduce the self resonant frequency. When the self resonant frequency considerably decreases and the used frequency is brought close to the lower part of the self resonance peak, the inductance value at the used frequency is widely varied among parts due to variations in performance among the parts. Further, when the used frequency is brought close to the lower part, the inductance value is widely varied also by temperature variations.

The inductance value of the coil, along with the capacitance of the capacitor, is a factor for determining the frequency to be used. A corresponding inductance value is set for each frequency to be used. When the inductance value varies, the resonance frequency for reception is displaced, so that reception at the used frequency becomes difficult and a coverage is reduced.

In response to this problem, the applicant has developed an antenna coil (Patent document 1). The coil has a winding portion formed with a core having flange portions on both ends. In the winding portion, layers of conductor are wound one by one from one of the flange portions such that outer layers of conductor incline to the flange portion. The winding operation is performed while being shifted to the other flange portion of the core.

In the antenna coil, the winding portion is formed by a winding method called oblique winding (bank winding) which can produce an excellent effect of reducing stray capacitance components occurring between layers of wound conductor.

Another method for reducing stray capacitance components occurring between layers of wound conductor may be to divide a winding portion into a plurality of sections.

Patent document 1: Japanese Unexamined Patent Publication No. 2003-332822

DISCLOSURE OF THE INVENTION

Problems to be Solved by the Invention

However, when a winding portion is formed by oblique winding (bank winding), layers of conductor may collapse in the process of winding the conductor, which may cause low product quality such as an unstable coil characteristic.

Moreover, when performing winding after dividing a winding portion into a plurality of sections, flange portions are necessary between sections in order to prevent layers of conductor from collapsing on the ends of the sections. Thus it is difficult to miniaturize the product. The method for dividing a winding portion into a plurality of sections is particularly unsuitable for an antenna coil because the coil has to be miniaturized. Such an antenna coil to be miniaturized is used for a radio communication technique such as RFID (Radio Frequency-Identification), for example, remote keyless entry for automobiles and an air pressure sensor of a tire.

Also in a transformer coil, winding is generally performed after a winding portion is divided into a plurality of sections in order to reduce a potential difference between the leading end and the terminal end of a secondary winding. Also in this case, flange portions are necessary between the sections, so that it is difficult to reduce the size and cost of the product.

The present invention is proposed in view of these circumstances. An object of the present invention is to provide a coil in which stray capacitance components between layers of wound conductor are reduced, so that fluctuations in the inductance value of the coil are reduced and the size and cost of a product can be reduced. The inductance value fluctuates due to differences in characteristics among parts or temperature variations.

Means for Solving the Problems

In order to attain the object, a coil of the present invention comprises a core which has two flange portions and is made of a magnetic material, and a winding portion made up of a plurality of layers of conductor wound around the core between the two flange portions of the core, characterized in that the winding portion is divided into a plurality of sections between the two flange portions, one layer of conductor is wound from one end to the other end in each section, and then layers of conductor are wound in alternately reversed directions to form a multilayer winding portion by solenoid winding.

The winding portion is preferably formed by winding the conductor such that a boundary surface between adjacent sections inclines to the flange portion at the winding start and the boundary surface of an upper layer is closer to the flange portion than the boundary surface of a lower layer.

The winding portion is preferably formed by winding the conductor such that in each end section, at least a portion near an upper layer of an end face facing the flange portion is apart from the flange portion so as to be farther from the flange portion than a lower layer of the end face.

The coil of the present invention can be used as an antenna coil or a transformer coil.

EFFECT OF THE INVENTION

As described above, in the coil of the present invention, the winding portion is divided into a plurality of sections and the conductor is wound around the core by solenoid winding in each section, thereby remarkably reducing a stray capacitance occurring between layers of wound conductor as compared with the prior art in which solenoid winding is performed on the overall length of the core.

Since the flange portions are not necessary between the sections, the size and cost of the product can be reduced.

The conductor is wound such that the boundary surface between adjacent sections inclines to the flange portion at the winding starting and the boundary surface of an upper layer is closer to the flange portion than that of a lower layer. Thus layers of conductor do not collapse on the boundary surface of each section and a high quality coil can be obtained.

It is wound the conductor such that in each end section, at least a portion near an upper layer of the end face facing the flange portion is apart from the flange portion so as to be farther from the flange portion than a lower layer of the end face. Thus a gap appears between the flange portion and the upper layer of the winding portion. Even the conductor is soldered in the vicinity of the flange portion, melted solder does not adhere between the flange portion and the winding portion and thus does not cause poor insulation.

BEST MODE FOR CARRYING OUT THE INVENTION

The following will specifically describe a coil according to embodiments of the present invention with reference to the accompanying drawings.

<First Embodiment>

FIG. 1 is a partial sectional view showing an antenna coil according to a first embodiment of the present invention. FIG. 2 is a perspective view showing the core of the antenna coil.

A core 20 used for an antenna coil 10 according to the first embodiment of the present invention includes, as shown in FIG. 2, flange portions 22*a* and 22*b* on both ends of a prismatic winding shaft portion 21. The core 20 is made of a ferrite material, which has excellent magnetic properties, with an overall length of about 1 cm.

On the core 20, a winding portion 30 is divided into a plurality of sections, and a thin conductor is wound about 700 to 800 turns in each section by solenoid winding, so that the antenna coil 10 is formed.

In solenoid winding, the conductor is wound from one end to the other end of the winding shaft portion 21 along the surface of the winding shaft portion 21 to form a first layer, and then the conductor is in a reversed direction wound from the other end to the one end to form a second layer. Thereafter, the conductor is similarly wound in alternately reversed directions to form a third layer and a fourth layer.

To be specific, as shown in FIG. 1, the winding portion 30 is divided into four sections of a first section 30*a*, a second section 30*b*, a third section 30*c*, and a fourth section 30*d* in this order from the left. In the first section 30*a*, the conductor is wound from one end of the winding shaft portion 21 (flange portion 22*a*) to the other end (second section 30*b*) along the surface of the winding shaft portion 21 to form a first layer, and then the conductor is in a reversed direction wound from the other end (second section 30*b*) to the one end (flange portion 22*a*) to form a second layer. Thereafter, the conductor is wound in alternately reversed directions to form a third layer and a fourth layer, so that the winding of the first section 30*a* is completed.

Subsequently in the second section 30*b*, the conductor is wound from one end of the winding shaft portion 21 (first section 30*a*) to the other end (third section 30*c*) along the surface of the winding shaft portion 21 to form a first layer, and then the conductor is in a reversed direction wound from the other end (third section 30*c*) to the one end (first section 30*a*) to form a second layer. Thereafter, the conductor is similarly wound in alternately reversed directions to form a third layer and a fourth layer, so that the winding of the second section 30*b* is completed.

Then, a conductor 31 is wound in the third section 30*c* and the fourth section 30*d* through the same steps, so that the winding operation is completed.

<Second Embodiment>

FIG. 3 is a partial sectional view showing an antenna coil according to a second embodiment of the present invention.

A antenna coil 110 according to the second embodiment of the present invention is similar to the antenna coil 10 according to the first embodiment in that a winding portion 130 is divided into four sections of a first section 130*a*, a second section 130*b*, a third section 130*c*, and a fourth section 130*d* in this order from the left and a conductor 131 is wound in each section by solenoid winding. The coil 110 is different from the coil 10 according to the first embodiment in that the conductor 131 is wound such that the boundary surface between adjacent sections inclines to a flange portion 122*a*, which is the winding start, and the boundary surface of an upper layer is closer to the flange portion 122*a* than that of a lower layer.

To be specific, as shown in FIG. 3, in the first section 130*a*, the conductor is wound from one end of a winding shaft portion 131 (flange portion 122*a*) to the other end (second section 130*b*) along the surface of the winding shaft portion 121 to form a first layer, and then the conductor is in a reversed direction wound from the other end (second section 130*b*) to the one end (flange portion 122*a*) to form a second layer. Thereafter, the conductor is wound in alternately reversed directions to form a third layer and a fourth layer, so that the winding of the left end section is completed.

In this case, the conductor 131 is wound to form the second layer such that the end face of the winding portion 130 is in contact with the flange portion 122*a* and the number of turns of the second layer is reduced from that of the first layer by about 50 turns. Then, the conductor 131 is wound to form the third layer such that the number of turns of the third layer is reduced from that of the second layer by about 50 turns. Further, the conductor 131 is wound to form the fourth layer such that the number of turns of the fourth layer is reduced from that of the third layer by about 50 turns. In this way, the conductor 131 is wound in alternately reversed directions while the number of turns is reduced.

Subsequently in the second section 130*b* and the third section 130*c*, the conductor 131 is wound by solenoid winding such that the winding portion 130 is shaped like a parallelogram in cross section.

Then, in the fourth section 130*d*, the conductor 131 is wound by solenoid winding in alternately reversed directions and the number of turns is increased such that the end face of the winding portion 130 is in contact with the flange portion 122*b*, so that the winding operation is completed.

The conductor 131 is wound through the foregoing steps, so that the boundary surface between adjacent sections inclines to the flange portion 22*a*, which is the winding start, and the boundary surface of an upper layer is closer to the flange portion than that of a lower layer. It is thus possible to positively prevent layers of conductor from collapsing on the boundary surface of each section.

<Third Embodiment>

FIG. 4 is a partial sectional view showing an antenna coil according to a third embodiment of the present invention. FIG. 5 is a perspective view showing the antenna coil according to the third embodiment of the present invention.

An antenna coil 210 according to the third embodiment of the present invention is similar to the antenna coil 10 according to the first embodiment in that a winding portion 230 is divided into four sections of a first section 230*a*, a second section 230*b*, a third section 230*c*, and a fourth section 230*d* in this order from the left and a conductor 231 is wound in each section by solenoid winding. The coil 210 is different from the coil 10 according to the first embodiment as follows: the conductor 231 is wound such that in each end section, portions near upper layers of end faces facing flange portions 222*a* and 222*b* are apart from the flange portions 222*a* and 222*b* so as to be farther from the flange portions than lower layers of the end faces.

As shown in FIGS. 4 and 5, the flange portions 222*a* and 222*b* of a core 220 include binding portions 241*a* and 241*b* protruding to the outside. The binding portions 241*a* and 241*b* are bound with the ends of the conductor 231, so that the ends of the conductor 231 are fixed.

The binding portions 241*a* and 241*b* are parts of terminal members 240*a* and 240*b* which are detachably attached to the main portions of the flange portions 222*a* and 222*b*. The terminal members 240*a* and 240*b* are almost shaped like letter C in cross section and made of a synthetic resin or the like having elasticity and flexibility. The terminal members 240*a* and 240*b* are engaged to the main portions of the flange portions 222*a* and 222*b*, so that the entire flange portions 222*a* and 222*b* are formed.

In the coil of the third embodiment, as shown in FIG. 4, the winding portion 230 is divided into four sections of the first section 230*a*, the second section 230*b*, the third section 230*c*, and the fourth section 230*d* in this order from the left. In the first section 230*a*, the conductor is wound from one end of the winding shaft portion 221 (flange portion 222*a*) to the other end (second section 230*b*) along the surface of the winding shaft portion 221 to form a first layer, and then the conductor is in a reversed direction wound from the other end (second section 230*b*) to the one end (flange portion 222*a*) to form a second layer. Thereafter, the conductor is wound in alternately reversed directions to form a third layer and a fourth layer, so that the winding of the first section 230*a* is completed.

In this case, the conductor 231 is wound to form (n+1)th layer such that a portion near the upper layer of the end face facing the flange portion 222*a* is apart from the flange portion 222*a*. For example, in the upper layer of n-th layer, the number of turns is reduced from that of n-th layer by about 50 turns. Then, the conductor 231 is wound to form (n+2)th layer. The number of turns of the (n+2)th layer is reduced from that of (n+1)th layer by about 50 turns. Further, the conductor 231 is wound to form (n+3)th layer. The number of turns of (n+3)th layer is reduced from that of (n+2)th layer by about 50 turns. In this way, the conductor 231 is wound in alternately reversed directions while the number of turns is reduced in upper layers. In this case, n represents a positive natural number.

The reduction in the number of turns may be started from any one of the layers. Instead of reducing the number of turns in each layer, the number of turns may be reduced, for example, every two layers or three layers.

Subsequently in the second section 230*b* and the third section 230*c*, the conductor 231 is wound through the same steps as the first embodiment.

Finally also in the fourth section 230*d*, the conductor 231 is wound through the same steps as the first section 230*a* while the number of turns is reduced in upper layers, so that the winding operation is completed.

The conductor 231 is wound through these steps, so that the end faces of the winding portion 230 facing the flange portions 222*a* and 222*b* are apart from the flange portions 222*a* and 222*b* such that an upper layer is farther from the flange portions 222*a* and 222*b* than a lower layer. Even when gaps appear between the upper portions of the flange portions 222*a* and 222*b* and the winding portions 230*a* and 230*d* and the conductor 231 is soldered in the vicinity of the flange portions 222*a* and 222*b*, melted solder does not adhere between the flange portions 222*a* and 222*b* and the winding portions 230*a* and 230*d* and thus does not cause poor insulation.

<Fourth Embodiment>

FIG. 6 is a plan view showing a transformer coil according to a fourth embodiment of the present invention. FIG. 7 is a partial sectional view showing the transformer coil according to the fourth embodiment of the present invention.

In a transformer coil 310 according to a fourth embodiment of the present invention, a winding portion 330 is divided into four sections on a secondary winding, and a conductor 331 is wound by solenoid winding in each section. The conductor 331 on the secondary winding is wound through almost the same steps as the antenna coil 10 according to the first embodiment.

To be specific, as shown in FIGS. 6 and 7, the transformer coil 310 according to the fourth embodiment of the present invention includes a coil bobbin 370, an I-shaped core 360 inserted into the coil bobbin 370, a C-shaped core 350 placed on both ends of the I-shaped core 360, and a terminal support 380 having terminals 381*a* to 380*f* for connecting a primary winding and the secondary winding.

The I-shaped core 360 and the C-shaped core 350 are made of a ferrite material having excellent magnetic properties.

The coil bobbin 370 has flange portions 371*a*, 371*b*, and 371*c* for winding a primary winding 340 and a secondary winding 330. Of the flange portions 371*a* to 371*c*, the flange portions 371*a* and 371*c* are disposed respectively on both ends of the coil bobbin 370, and the flange portion 371*b* is disposed on the boundary of the primary winding 340 and the secondary winding 330.

On the primary winding 340, a conductor 341 is wound by solenoid winding along an overall length between the flange portion 371*a* and the flange portion 371*b*.

The secondary winding 330 is divided into four sections of a first section 330*a*, a second section 330*b*, a third section 330*c*, and a fourth section 330*d* in this order from the left. In the first section 330*a*, the conductor is wound from one end of the coil bobbin 370 (flange portion 371*b*) to the other end (second section 330*b*) along the surface of the coil bobbin 370 to form a first layer, and then the conductor is in a reversed direction wound from the other end (second section 330*b*) to the one end (flange portion 371*b*) to form a second layer. Thereafter, the conductor is wound in alternately reversed directions to form a third layer and a fourth layer, so that the winding of the first section 330*a* is completed.

Subsequently in the second section 330*b*, the conductor is wound from the one end of the coil bobbin 370 (first section 330*a*) to the other end (third section 330*c*) along the surface of the coil bobbin 370 to form a first layer, and then the conductor is in a reversed direction wound from the other end (third section 330*c*) to the one end (first section 330*a*) to form a second layer. Thereafter, the conductor is similarly wound in alternately reversed directions to form a third layer and a fourth layer, so that the winding of the second section 330*b* is completed.

Then the conductor 331 is wound in the third section 330*c* and the fourth section 330*d* through the same steps, so that the winding operation is completed.

<Stray Capacitance Occurring Between Layers of Wound Conductor>

As described above, the winding portion is divided into a plurality of sections and the conductor is wound by solenoid winding in each section according to the embodiments of the present invention, so that a stray capacitance occurring between layers of wound conductor can be considerably reduced as compared with the prior art in which a conductor is wound by solenoid winding along the overall length of a winding portion.

In other words, the length L1 of layers is about one fourth the length L2 of layers in the example of FIG. 9 illustrating the prior art. It is evident that the embodiments of the present invention can dramatically reduce the length of layers. Thus it is possible to considerably reduce stray capacitance components.

The following will describe a reduction of stray capacitance components in the antenna coil according to the present embodiment.

In the antenna coil according to the present embodiment, stray capacitance components can be considerably reduced and thus it is possible to increase the value of self resonant frequency $f_p$ $(=1/(2\pi(LC_p)^{1/2}))$ which is resulted from stray capacitance component $C_p$ and inductance component L of the coil (inductor).

The self resonant frequency considerably increases thus and the frequency to be used (resonance frequency to be used) can be placed on a part which is apart from the lower part of the self resonance peak to the low frequency side and has a stable characteristic. Therefore even in the presence of variations in performance between the parts or large fluctuations in ambient temperature, the inductance value does not greatly vary at the used frequency.

As described above, the inductance value, along with the capacitance of the capacitor, is a factor for determining the frequency to be used. A corresponding inductance value is set for each frequency to be used. According to the present embodiment, the inductance value does not greatly vary at the used frequency and thus the resonance frequency for reception is stabilized, so that reception at the used frequency does not become difficult or a coverage is not reduced.

FIG. 8 is a circuit diagram showing an example in which the antenna coil according to the present embodiment is used for a typical switching circuit. To be specific, a capacitor 420 with a predetermined capacitance is connected in parallel with an antenna coil 410, and both ends of the conductor of the antenna coil 410 are connected to receiving means 430. The receiving means 430 can open or close a switch 440.

The antenna coil 410 resonates in response to a radio signal of a used frequency of $f(=1/(2\pi(LC)^{1/2}))$, which is determined by the inductance component L and the capacitance component C of the capacitor 420. It is accordingly recognized that the receiving means 430 has received a predetermined signal. The receiving means 430 closes the switch 440 in response to the recognition, so that the circuit including the switch 440 is turned on. The antenna coil 410 according to the present embodiment is used for such a switching circuit, so that receiving sensitivity does not decrease even in the presence of variations in properties between parts or large fluctuations in ambient temperature. Thus no malfunction occurs when the circuit including the switch 440 is turned on/off.

Further, in the transformer coil according to the present embodiment, the secondary winding is divided into a plurality of sections (for example, four sections) and thus a potential difference between the leading end and the terminal end of the secondary winding can be reduced. In this case, flange portions are not necessary between the sections and thus it is possible to reduce the size and cost of the product.

<Another Embodiment>

The coil of the present invention is not limited to the foregoing embodiments and various modification can be made. For example, although the two flange portions are formed on both ends of the core in the antenna coil, the flange portions may be formed at some points of the core.

Moreover, the number of divisions of the winding portion is not limited to those of the embodiments and can be changed as appropriate.

The core, the I-shaped core, and the C-shaped core are made of ferrite. The material of the core is not limited to ferrite and may be selected from other typical core materials (ferromagnetic materials). For example, it is possible to use materials such as Permalloy, Sendust and iron carbonyl and a dust core formed by compression molding fine powder of these materials.

DESCRIPTION OF SYMBOLS

Figure 1:
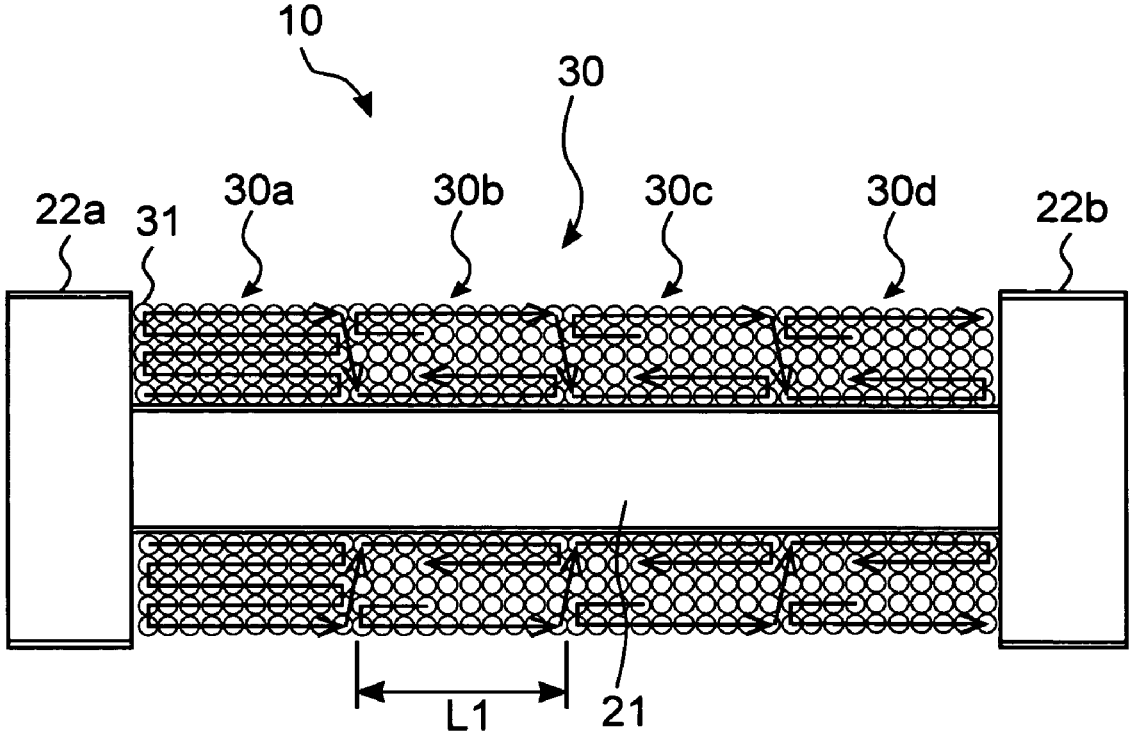
FIG. 1 is a partial sectional view showing an antenna coil according to a first embodiment of the present invention.
Figure 2:
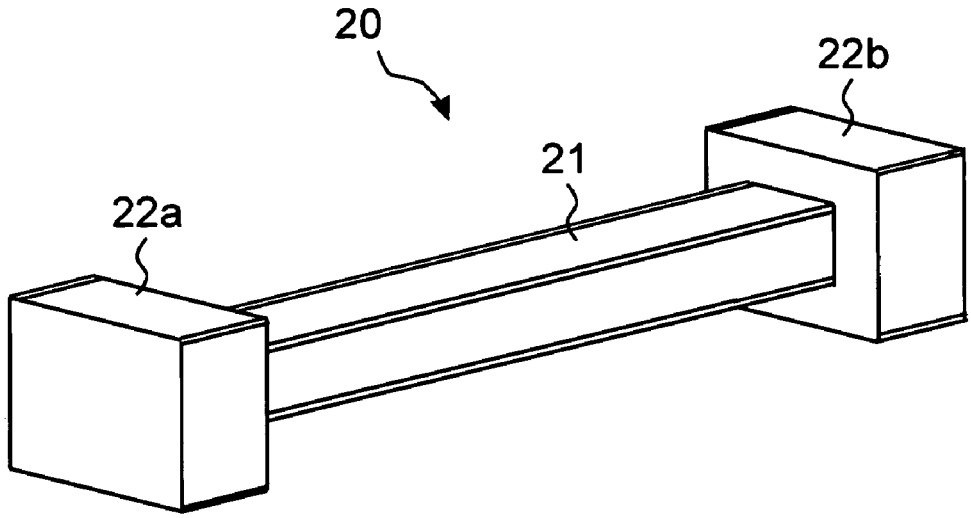
FIG. 2 is a perspective view showing the core of the antenna coil according to the first embodiment of the present invention.
Figure 3:
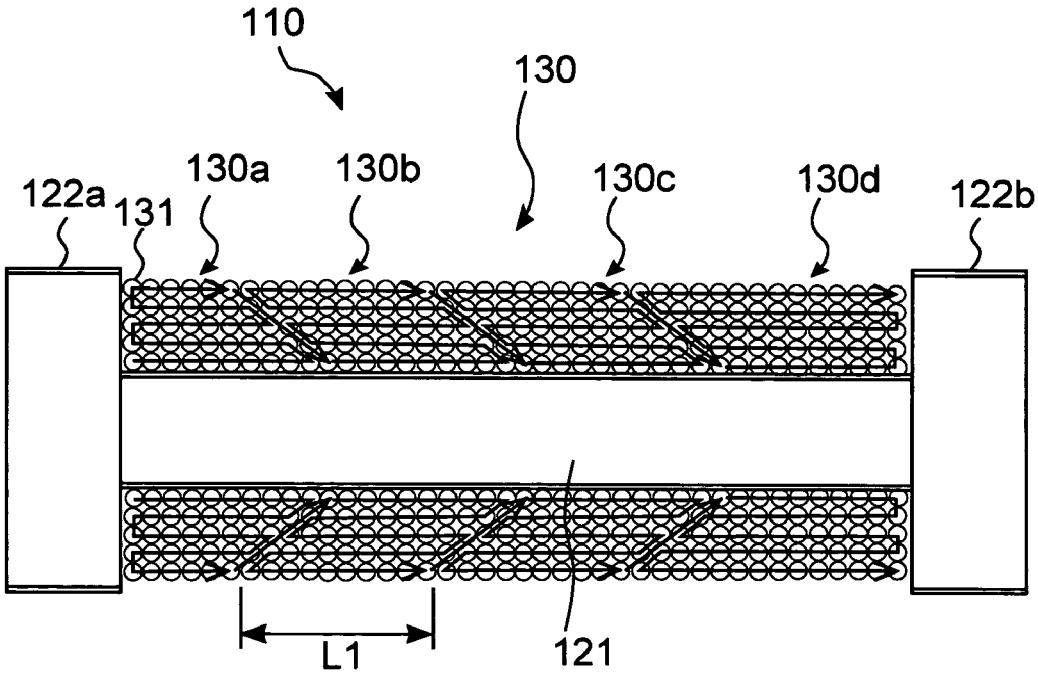
FIG. 3 is a partial sectional view showing an antenna coil according to a second embodiment of the present invention.
Figure 4:
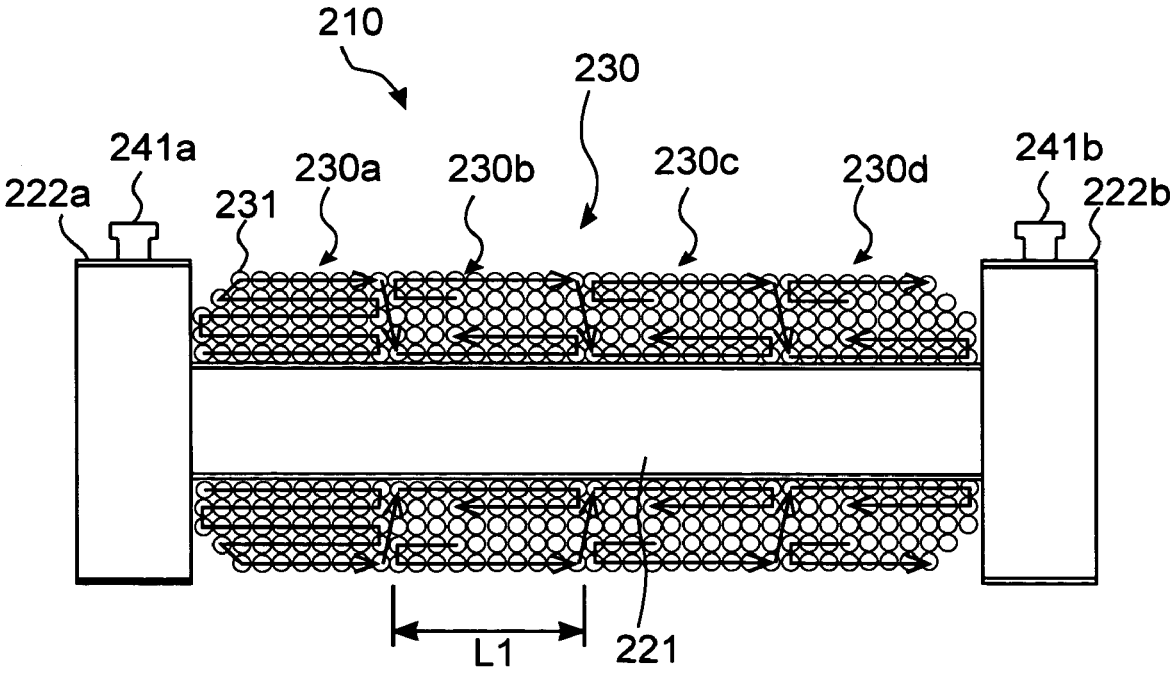
FIG. 4 is a partial sectional view showing an antenna coil according to a third embodiment of the present invention.
Figure 5:
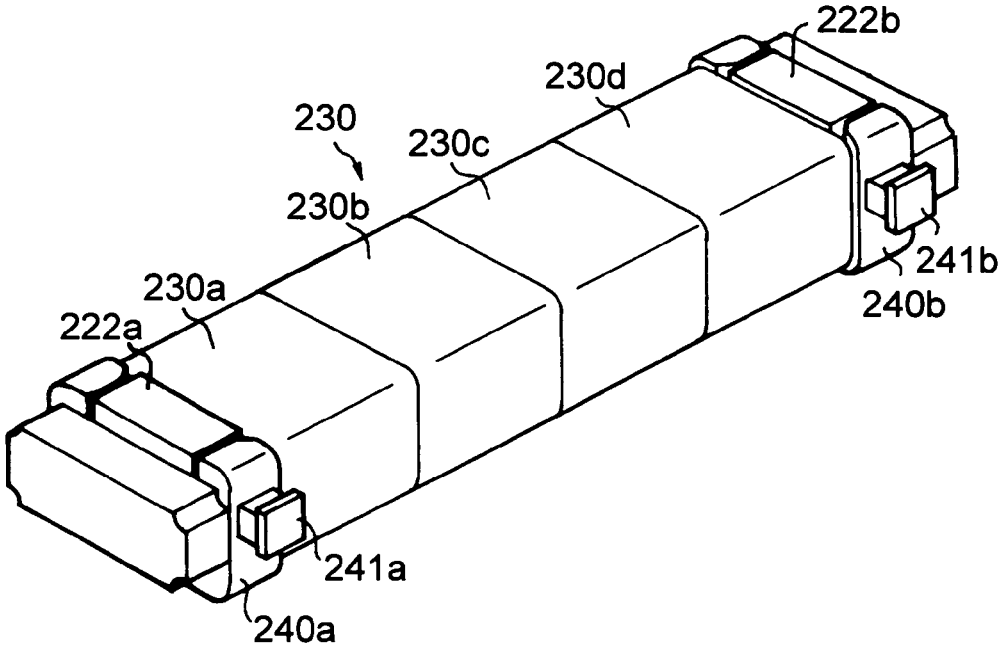
FIG. 5 is a perspective view showing the antenna coil according to the third embodiment of the present invention.
Figure 6:
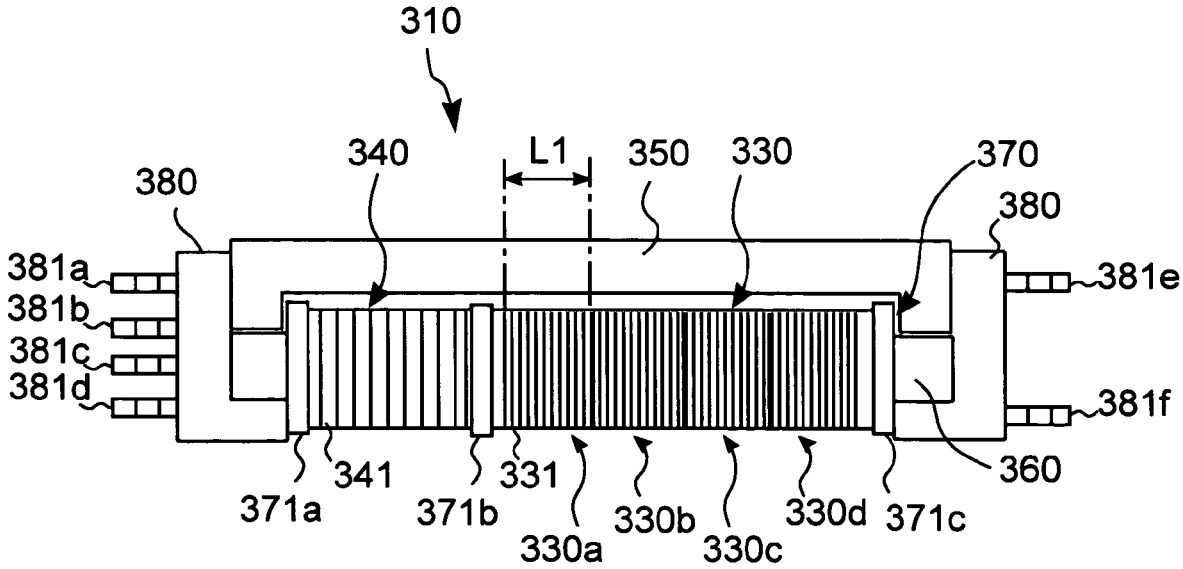
FIG. 6 is a plan view showing a transformer coil according to a fourth embodiment of the present invention.
Figure 7:
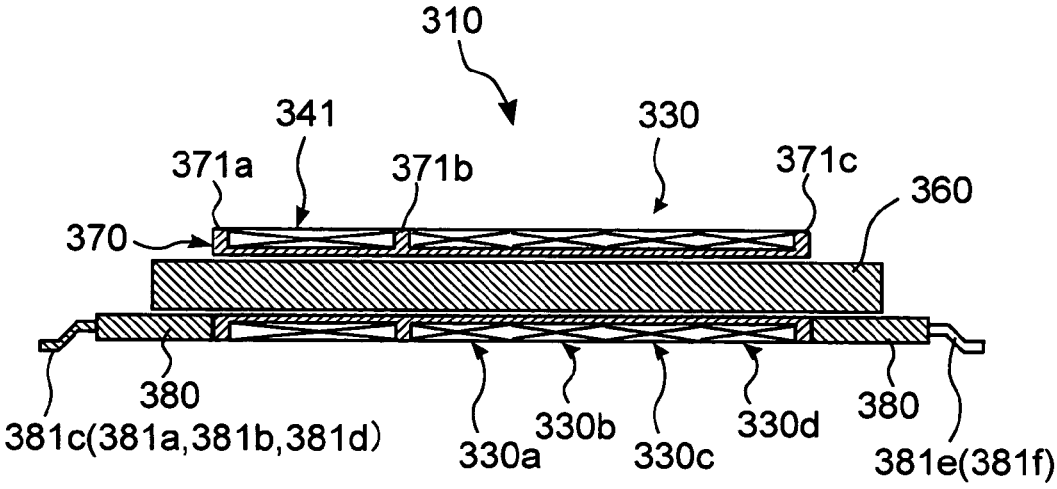
FIG. 7 is a partial sectional view showing the transformer coil according to the fourth embodiment of the present invention.
Figure 8:
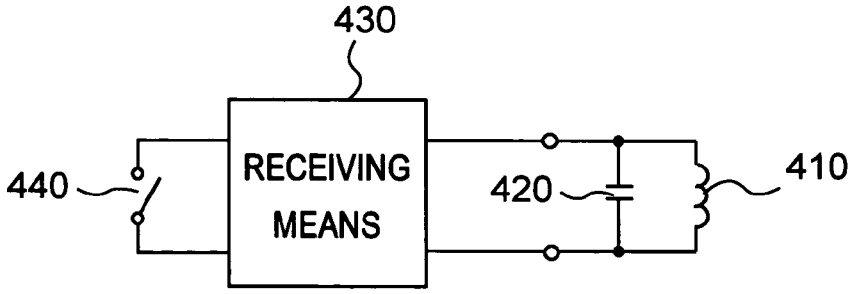
FIG. 8 is a circuit diagram showing an example in which the antenna coil according to the present embodiment is used for a typical switching circuit.
Figure 9:
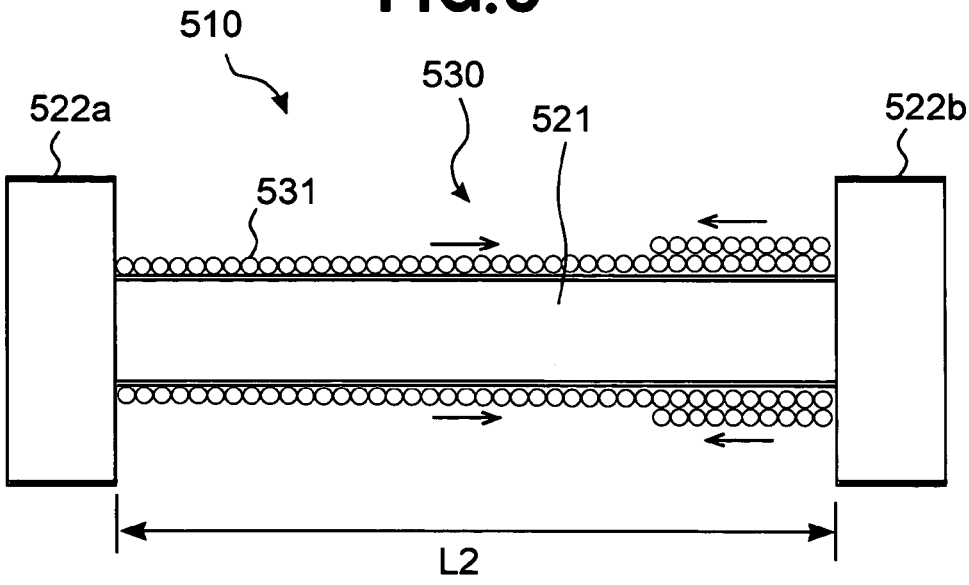
FIG. 9 is a partial sectional view showing a typical coil used for a conventional antenna or transformer.

10, 110, 210, 310, 410 antenna coil
20, 220, 320 core
21, 121, 221 winding shaft portion
22*a*, 22*b*, 122*a*, 122*b*, 222*a*, 222*b* flange portion
30, 130, 230, 330 winding portion
30*a*, 130*a*, 230*a*, 330*a* first section
30*b*, 130*b*, 230*b*, 330*b* second section
30*c*, 130*c*, 230*c*, 330*c* third section
30*d*, 130*d*, 230*d*, 330*d* fourth section
31, 131, 231, 331 conductor
241*a*, 241*b* binding portion
240*a*, 240*b* terminal member
310 transformer coil
330 secondary winding
340 primary winding
341 conductor of the primary winding
350 C-shaped core
360 I-shaped core
370 coil bobbin
371*a* to 371*c* flange portion
380 terminal support
381*a* to 381*f* terminal
420 capacitor
430 receiving means
440 switch
510 conventional coil
521 winding shaft portion
522*a*, 522*b* flange portion
530 winding portion
531 conductor

The invention claimed is:

1. The coil, comprising:

a core which has two flange portions and is made of a magnetic material, and a winding portion made up of a plurality of layers of conductor wound around the core between the two flange portions of the core, characterized in that the winding portion is divided into a plurality of sections between the two flange portions, one layer of conductor is wound from one end to the other end in each section, and then layers of conductor are wound in alternately reversed directions to form a multilayer winding portion by solenoid winding characterized in that the winding portion is formed by winding the conductor such that in each end section, at least a portion near an upper layer of an end face facing the flange portion is apart from the flange portion so as to be farther from the flange portion than a lower layer of the end face.

2. The coil, comprising:

a core which has two flange portions and is made of a magnetic material, and a winding portion made up of a plurality of layers of conductor wound around the core between the two flange portions of the core, characterized in that the winding portion is divided into a plurality of sections between the two flange portions, one layer of conductor is wound from one end to the other end in each section, and then layers of conductor are wound in alternately reversed directions to form a multilayer winding portion by solenoid winding, characterized in that the flange portion includes a main portion and a flexible member which is detachably attached to the main portion and shaped like letter C in cross section.

3. The coil according to claim 2, characterized by further comprising a binding portion on an outer surface of the flexible member, the binding portion being bound with a portion near an end of the conductor.

4. A coil, comprising:

a core which has two flange portions and is made of a magnetic material, and a winding portion made up of a plurality of layers of conductor wound around the core between the two flange portions of the core, wherein the winding portion is divided into a plurality of sections between the two flange portions, one layer of conductor is wound from one end to the other end in each section, and then layers of conductor are wound in alternately reversed directions to form a multilayer winding portion by solenoid winding, and the number of turns of each of the sections at both ends is smaller than the number of turns of each of the sections between both ends.

5. The coil according to claim 4, wherein the winding portion is formed by winding the conductor such that a boundary surface between adjacent sections inclines to the flange portion of a winding start and the boundary surface of an upper layer is closer to the flange portion than the boundary surface of a lower layer.

6. The coil according to claim 4, wherein the winding portion is formed by winding the conductor such that in each end section, at least a portion near an upper layer of an end face facing the flange portion is apart from the flange portion so as to be farther from the flange portion than a lower layer of the end face.

7. A coil according to claim 4, wherein the flange portion includes a main portion and a flexible member which is detachably attached to the main portion and shaped like letter C in cross section.

8. The coil according to claim 7, characterized by further comprising a binding portion on an outer surface of the flexible member, the binding portion being bound with a portion near an end of the conductor.

9. The coil according to claim 4, wherein the flange portion is provided on each end of the core.

* * * * *